US009592837B2

(12) United States Patent
McLaughlin et al.

(10) Patent No.: US 9,592,837 B2
(45) Date of Patent: Mar. 14, 2017

(54) VALVE FOR OUTLET GATE ASSEMBLY FOR HOPPER CARS

(71) Applicant: Salco Products, Inc., Lemont, IL (US)

(72) Inventors: James M. McLaughlin, New Lenox, IL (US); David A. Oestermeyer, Downers Grove, IL (US); Alex V. Degutis, La Grange Park, IL (US); Joshua J. Chesser, Lockport, IL (US); Clayton J. Strand, Bollingbrook, IL (US); Matthew C. Huang, Lisle, IL (US); William R. Borowski, Palos Park, IL (US)

(73) Assignee: SALCO PRODUCTS, INC., Lemont, IL (US)

( * ) Notice: Subject to any disclaimer, the term of this patent is extended or adjusted under 35 U.S.C. 154(b) by 170 days.

(21) Appl. No.: 14/532,527

(22) Filed: Nov. 4, 2014

(65) Prior Publication Data

US 2015/0166078 A1 Jun. 18, 2015

Related U.S. Application Data

(60) Provisional application No. 61/899,561, filed on Nov. 4, 2013.

(51) Int. Cl.
*B61D 7/26* (2006.01)

(52) U.S. Cl.
CPC ..... *B61D 7/26* (2013.01)

(58) Field of Classification Search
CPC ... B61D 7/00; B61D 7/02; B61D 7/04; B61D 7/06; B61D 7/08; B61D 7/12; B61D 7/14; B61D 7/16; B61D 7/20; B61D 7/24; B61D 7/26; B61D 7/30
See application file for complete search history.

(56) References Cited

U.S. PATENT DOCUMENTS

| | | | | |
|---|---|---|---|---|
| 5,671,684 | A * | 9/1997 | Lucas | B61D 7/26 105/282.3 |
| 6,263,803 | B1 * | 7/2001 | Dohr | B61D 7/26 105/282.1 |
| 6,412,421 | B2 * | 7/2002 | Dohr | B61D 7/20 105/247 |
| 7,493,865 | B2 * | 2/2009 | Galvan | B61D 7/18 105/280 |
| 2013/0068128 | A1 * | 3/2013 | Senn | B61D 7/26 105/282.2 |

* cited by examiner

*Primary Examiner* — R.J. McCarry, Jr.
(74) *Attorney, Agent, or Firm* — Leydig, Voit & Mayer, Ltd.

(57) ABSTRACT

An outlet gate assembly includes a body and an elongated discharge opening. An elongated discharge conduit is generally adjacent the discharge opening and is configured to pass material through either of the first discharge end and the second discharge end. A valve assembly controls the flow of material from the discharge opening into the discharge conduit and includes a direct motion component and a lost motion component and a lost motion coupling between the direct motion component and the lost motion component. Each of the direct motion component and the lost motion component is rotatable to move between an open position and a closed position and the valve assembly is operable from either the first end or the second end of the body.

20 Claims, 9 Drawing Sheets

VALVE FOR OUTLET GATE ASSEMBLY FOR HOPPER CARS

CROSS REFERENCE TO RELATED APPLICATION

This application claims priority pursuant to Title 35 USC §119(e) to U.S. Provisional Application No. 61/899,561 filed Nov. 4, 2013, entitled "Valve for Outlet Gate Assembly for Hopper Cars," the entire contents of which are hereby incorporated by reference herein as if fully set forth.

TECHNICAL FIELD

This disclosure relates generally to outlet gate assemblies used on railroad hopper cars, and, more particularly, to a valve for use with an outlet gate assembly.

Railroad hopper cars are used to transport material or bulk lading through railway systems. A railroad hopper car typically includes discharge or outlet gate assemblies located on the underside of the ear for unloading the transported materials. The outlet gate assemblies typically include one or more valve components that may be selectively moved between closed and open positions to permit discharge of the material.

When transporting granular or particulate matter such as plastic pellets, vacuum discharge systems are often used to unload the hopper cars. The outlet gate assemblies used with vacuum discharge systems typically include a discharge tube positioned beneath the valve and that extends between opposite sides of the outlet gate assembly. Such gates are illustrated in patents U.S. Pat. No. 3,797,891, U.S. Pat. No. 4,902,173 and U.S. Pat. No. 6,357,361.

Different types of valves and other mechanisms are used to control the discharge of materials from the hopper car. One type of outlet gate assembly uses a rotatable valve that controls the flow of material from the outlet gate assembly.

The outlet gate assembly of the present disclosure is configured for particularly convenient use. In this regard, it is fully operable by an operator from only one side of the railroad car.

After unloading a hopper car, it is often desirable or necessary to thoroughly clean the hopper car including the outlet gate assembly to prepare the hopper car for hauling a subsequent load of material. Failure to properly clean the hopper car and outlet gate assembly may result in the contamination of the subsequent load. In some instances, it may be necessary to remove the outlet gate assembly from the hopper car to ensure that all of the material has been removed during the cleaning process. Some types of materials may be especially difficult to clean from the valve of an outlet gate assembly. Accordingly, it would be desirable to provide a valve that permits flexibility in the manner in which a hopper car is unloaded yet may be easily removed to permit cleaning of the outlet gate assembly. Such an advantage is provided by the outlet gate of this disclosure.

The foregoing background discussion is intended solely to aid the reader. It is not intended to limit the innovations described herein, nor to limit or expand the prior art discussed. Thus, the foregoing discussion should not be taken to indicate that any particular element of a prior system is unsuitable for use with the innovations described herein, nor is it intended to indicate that any element is essential in implementing the innovations described herein. The implementations and application of the innovations described herein are defined by the appended claims.

SUMMARY OF THE DISCLOSURE

In accordance with the disclosure, an outlet gate assembly for a hopper car includes a body having a first end and a second end and an elongated discharge opening that extends between the first end and the second end. An elongated discharge conduit is generally adjacent the discharge opening and extends along a length thereof and has a first discharge end and a second discharge end. The discharge conduit is configured to pass material through either of the first discharge end and the second discharge end. A valve assembly controls the flow of material from the discharge opening into the discharge conduit and includes a direct motion component and a lost motion component and a lost motion coupling between the direct motion component and the lost motion component. Each of the direct motion component and the lost motion component is rotatable to move between an open position and a closed position and the valve assembly is operable from either the first end or the second end of the body.

DETAILED DESCRIPTION OF ILLUSTRATED EMBODIMENTS

Figure 1:
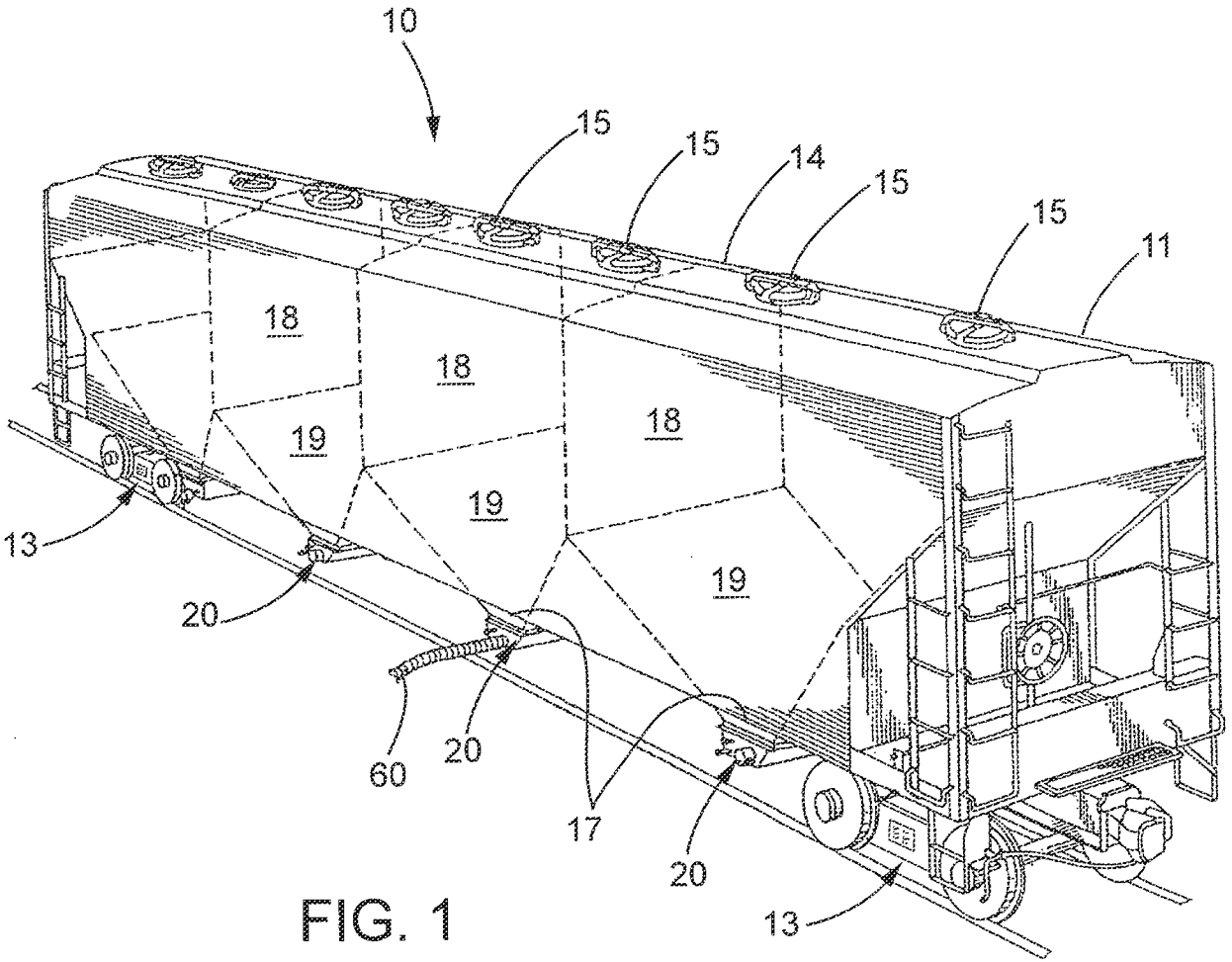
FIG. 1 is a perspective view of railroad hopper car including a plurality of outlet gate assemblies according to the present disclosure.
Figure 2:
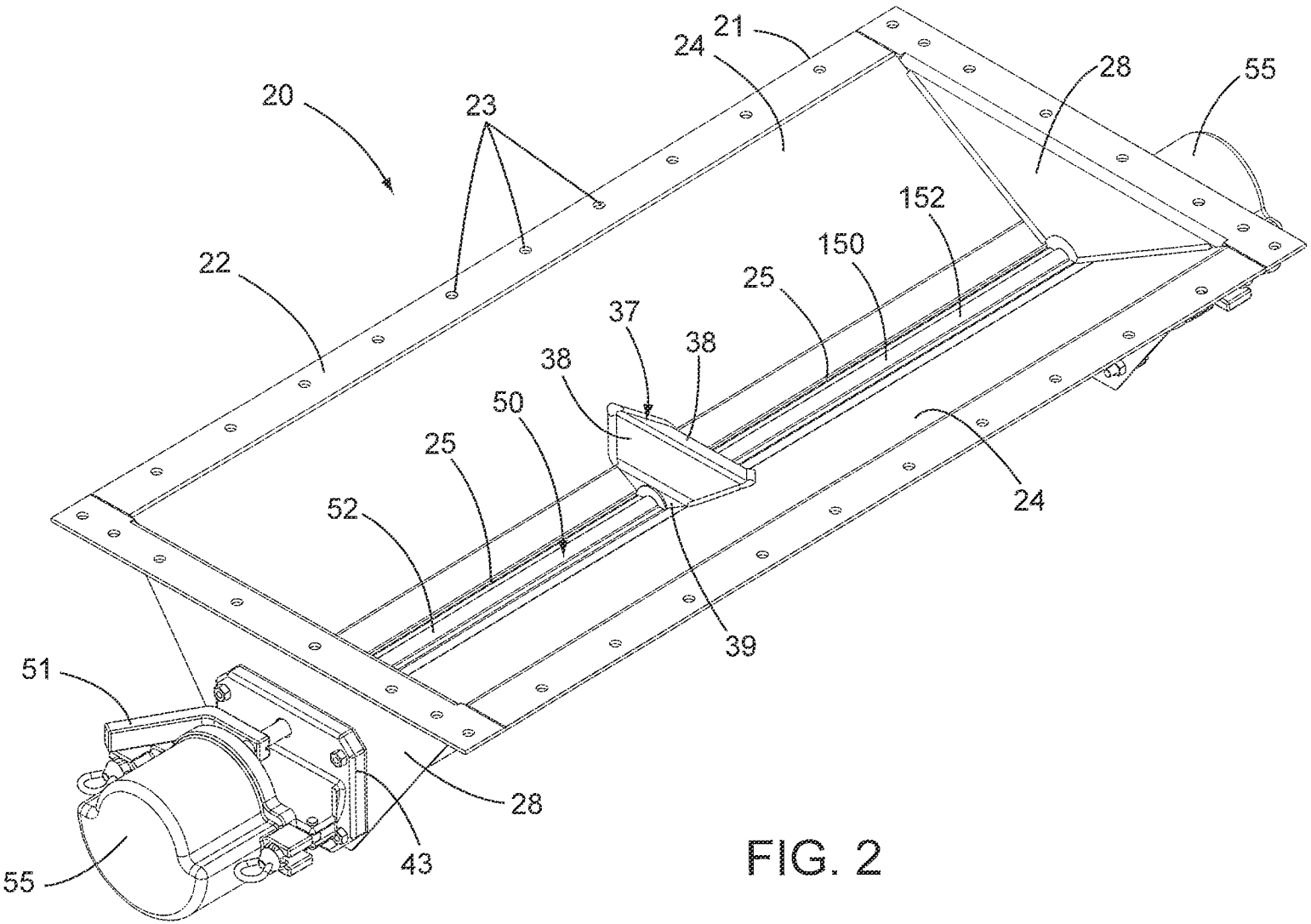
FIG. 2 is a perspective view of an outlet gate assembly of the present disclosure.
Figure 3:
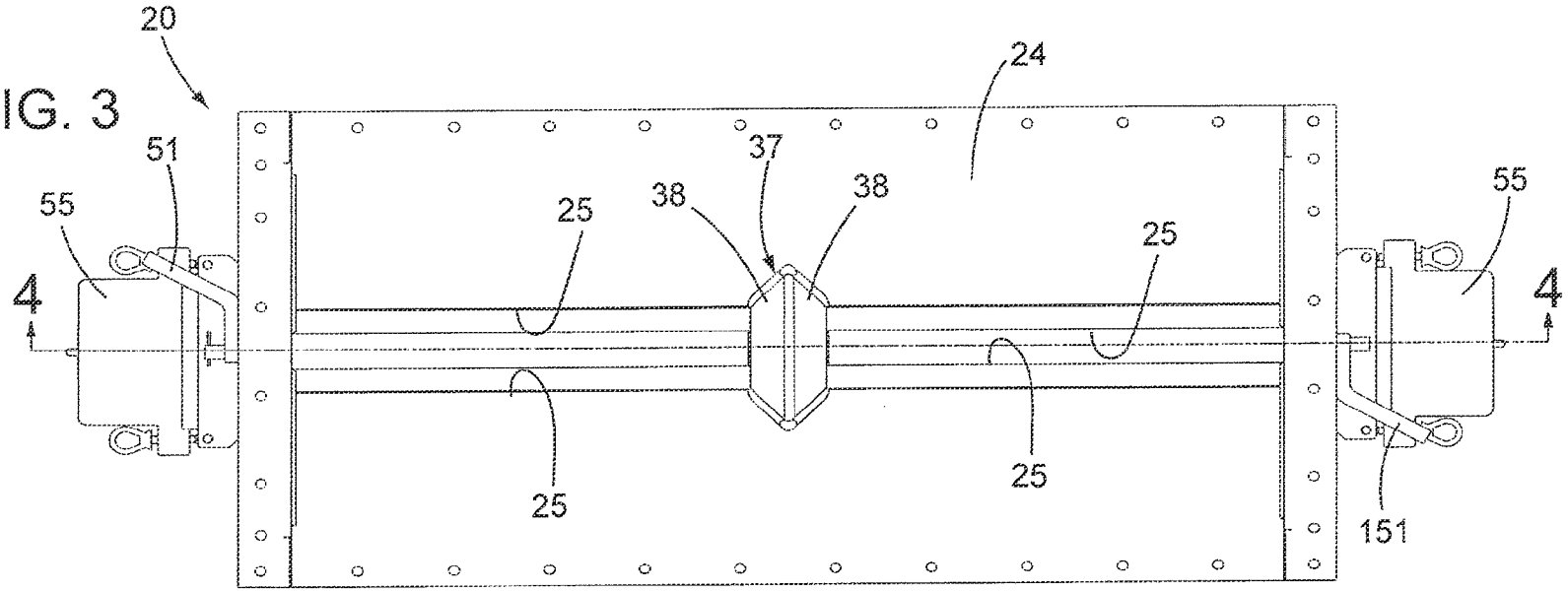
FIG. 3 is a top view of the outlet gate assembly of FIG. 2.

A covered railroad hopper car 10, equipped with gate assemblies according to the present disclosure is illustrated in FIG. 1. The railroad hopper car 10 may include a multi-walled enclosure 11 for storing and transporting granular or particulate material such as plastic pellets and other fluent materials. The multi-walled enclosure 11 is supported by wheeled trucks, generally designated 13 at opposite ends of the car 10. Enclosure 11 includes a plurality of separate compartments, or hoppers 18 each of which are filled with granular or particulate material to be transported.

The upper portion 14 of the enclosure 11 may have a plurality of hatch openings (not shown) in communication with the separate hoppers 18. Each hatch opening includes a hatch cover 15 that may be opened to permit material to be loaded into the hopper 18. In some configurations, the covers 15 may need to be opened to permit air flow during unloading. Alternately, the hatch covers 15 may be vented to facilitate air flow without the necessity of opening sealed hatch covers.

The lower portion of each hopper 15 of enclosure 11 is provided with a separate opening 17 for facilitating the discharge of materials from within the hoppers 18. The hoppers 18 have sloped walls or surfaces 19 funneling downwardly toward each opening 17 to promote the discharge of materials therefrom. An outlet gate assembly, generally designated 20, covers each opening 17 along the lower portion 16 of the hopper car 10. The outlet gate assemblies 20 control the flow of material from the hopper car 10.

A particular advantage of the outlet gate assembly 20 of the present disclosure is that it may be operated by an operator from only one side of the railroad car 10. This capability provides a significant reduction in the time necessary to unload a car. It also provides meaningful safety advantages in that the user or operator of the outlet gate assembly 20 does not experience the dangers attendant with movement from one side of the car to the opposite side while performing an unloading function.

Notably, the side from which a workman operates the outlet gate valve to discharge the contained lading is referred to as the near side of the car. The opposite side, (i.e., the side remote from the user of the outlet gate) is denominated the far side.

Each outlet gate assembly 20 extends transversely of the car 10. For purposes of describing the structure and operation of the outlet gate assemblies of the present disclosure, the side of the railroad car 10 seen in FIG. 1 is considered to be the near side. The opposite side is considered the far side. Also, in this description "inner" means toward the longitudinal center of the railroad car 10. "Outer" means toward the near side or toward the far side of the car 10.

Figure 6:
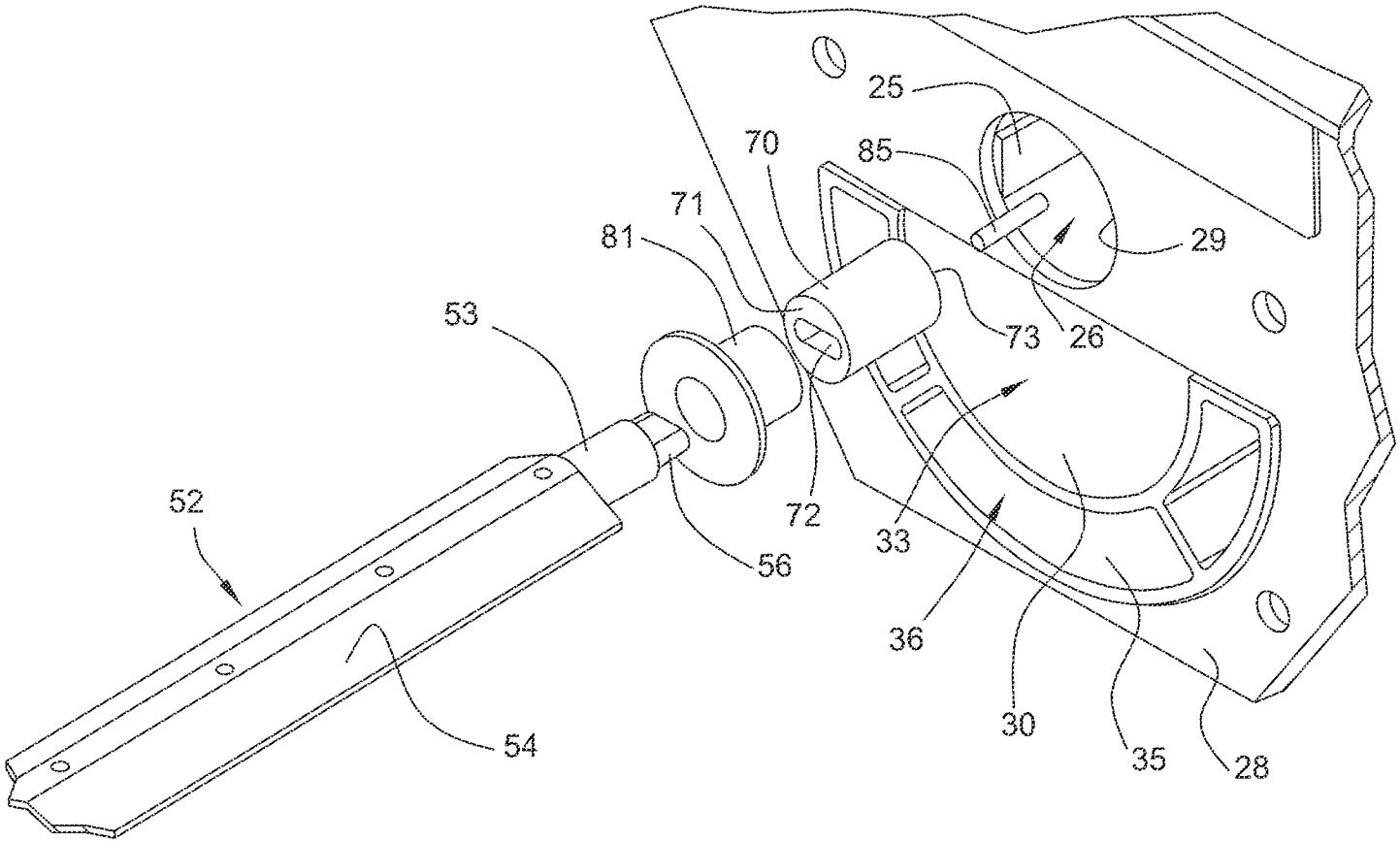
FIG. 6 is an enlarged perspective view of a portion of FIG. 5.

Referring to FIGS. 2-5, one of the outlet gate assemblies 20 is depicted in greater detail. Outlet gate assembly 20 has a body 21 configured to be secured to the hopper car 10 through generally rectangular flange 22 at an upper surface thereof. Generally rectangular flange 22 may have a plurality of spaced apart holes 23 through which fasteners such as bolts (not shown) may pass to secure the outlet gate assembly 20 to the hopper car 10 overlying the associated opening 17. Sloped sidewalls 24, extending between transverse, vertical, end walls 28, slope downward and inward from the inner edges of flange 22 to form a generally funnel-like structure. Parallel, vertical sidewalls 25, at the bottom ends of sidewalls 24, define an elongate opening 26 extending between end walls 28. The sloped sidewalls 24 and vertical sidewalls 25 guide material from the hopper car 10 through a discharge opening 26. End walls 28 include aligned openings 29 (FIG. 6) in communication with discharge opening 26.

A central valve shaft support 37 is positioned midway between the transverse end walls 28. The valve shaft support 37 is mounted on sloped sidewalls 24 approximately midway between end walls 28 and divides discharge opening 26 into a near section and a far section. It includes a tent-like center portion with sloping transverse walls 38 and spaced apart vertical walls 39 with openings aligned with openings 29 in end walls 28. The space within central valve shaft support 37 between walls 39 defines a coupler pocket as be explained below.

A generally cylindrical trough-like discharge tube 30 extends between the end walls 28 below the discharge opening 26. The discharge tube 30 may have other shapes and configurations as desired.

Referring to FIGS. 3-6, an air flow tube 35 extends generally parallel to the discharge tube 30 and provides a route or path for air to enter the discharge tube 30. The air flow tube 35 extends between the opposite end walls 28 of the outlet gate assembly 20 and has a crescent or semi-annular cross-section that is concentric with the discharge tube 30. Other shapes and configurations of air flow tube 35 are contemplated and are not a critical feature.

An end adapter 40 is mounted on each end wall 28 of the outlet gate assembly 20. Each end adapter 40 includes a cylindrical outlet tube 41 configured to permit a vacuum hose 60 (FIG. 1) to be attached when unloading the hopper car 10. Each end adapter 40 includes a flange or bracket 43, configured to mount the end adapter 40 to the end wall 28 of the outlet gate assembly 20.

Figure 4:
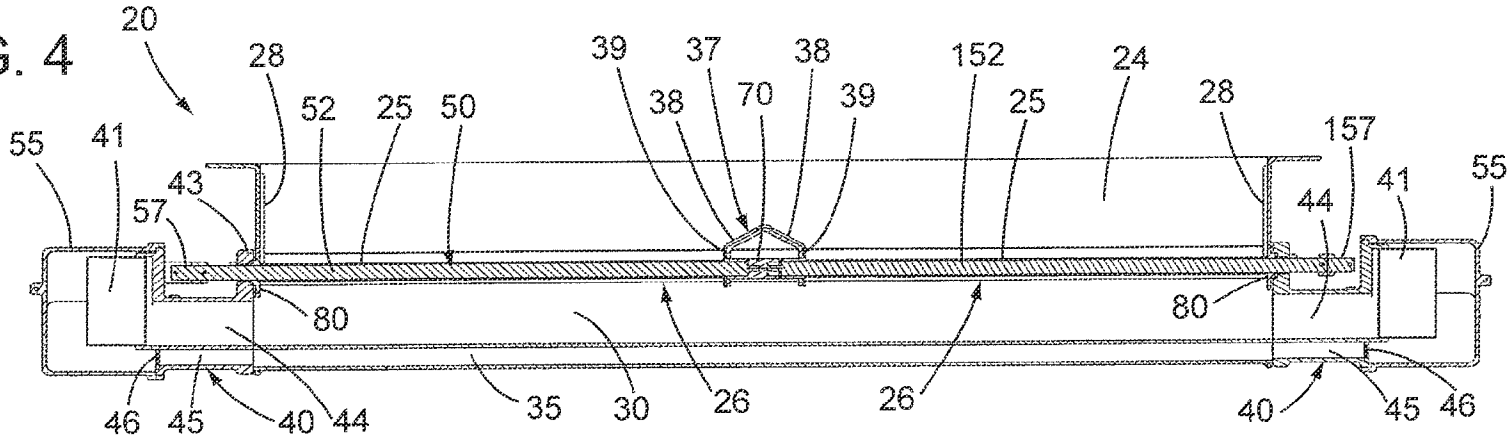
FIG. 4 is a sectional side view of the outlet gate assembly of FIG. 2 taken along the line 4-4 of FIG. 3.
Figure 5:
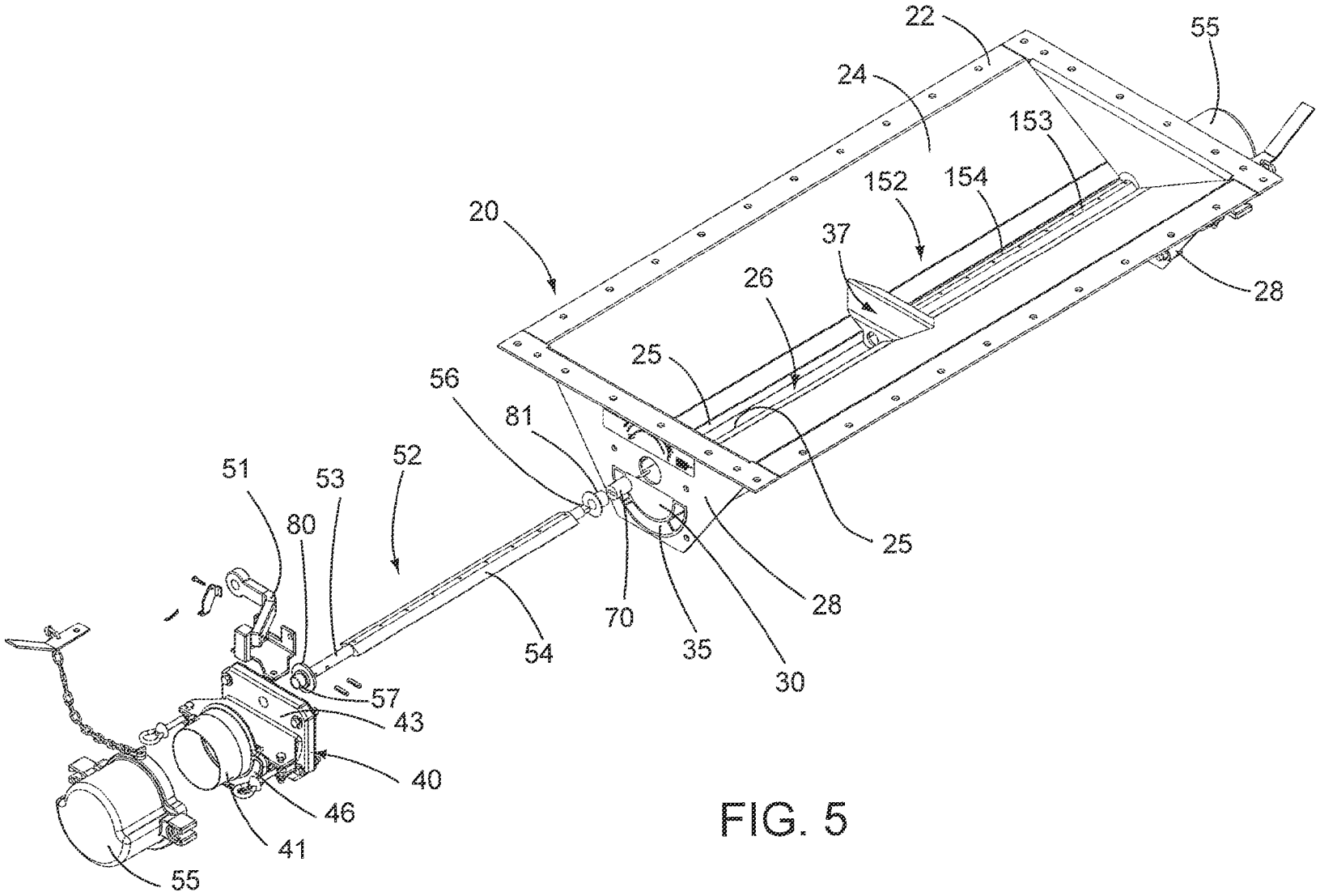
FIG. 5 is an exploded perspective view of the outlet gate assembly of FIG. 2 illustrating features of the discharge valve.

Referring to FIG. 4, bracket 43 defines a material flow passage 44 and an air flow passage 45 with an air flow opening 46. The material flow passage 44 is generally aligned with and connects the outlet tube 41 and the interior passage defined by discharge tube 30. Accordingly, material flowing through the discharge tube 30 passes through the material flow passage 44 of end adapter 40 before exiting through outlet tube 41.

The end opposite air flow opening 46 of air flow passage 45 of the end adapter 40 is generally aligned with and connects with the air flow tube 35 of outlet gate assembly 20. The air flow opening 46 provides communication with a source of air such as ambient air. A filter or filter assembly (not shown) may be positioned in flow passage 45 to prevent entrained foreign objects or materials from entering the air flow passage 45 to avoid possible contamination of the fluent material as it is discharged from the hopper car 10.

An outlet tube cap 55 is removably supported in overlying relation to the outlet tube 41 of each end adapter 40 to seal the discharge tube 30 at each end of outlet gate assembly 20. In addition, the cap 55 covers the open end, or air flow opening 46 of air flow passage 45 of the associated end adapter 40. Caps 55 are closed at one end and include an open end configured to seal against the free end of end adapter 40, enclosing the open ends of cylindrical outlet tube 41 and open end 46 of air flow passage 45. With both caps 55 in place, the material flow passage 44 and air flow passage 45 are closed and sealed against the elements.

With this configuration, upon removing one of the caps 55, for example, the cap 55 at the near end of the outlet gate, the discharge tube 30, the material flow passage 44, and the cylindrical outlet tube 41 form a first flow path through which material to be discharged from hopper car 10 may flow. Also, air flow tube 35 and air flow passages 45 form a second flow path through which ambient air may enter air flow opening 46 of the air flow passage 45 exposed by the removal of cap 55. Such air may pass through air flow tube 35, and through the other air flow passage 45 and out its respective air flow opening 46 into the interior of the cap 55, for example at the far end, that remains mounted on the end adapter 40 at the far end. The interior of the mounted cap 55 defines a path to direct air flow into the far, or remote end, of the discharge tube 30.

In an alternate embodiment, the air flow tube 35 may be omitted, and the end adapter 40 modified from that depicted to eliminate the air flow passage 45. In such case, when unloading material from the hopper car 10, the cap 55 at each end of the discharge tube 30 must be removed. Upon connecting the vacuum hose 60 to one end of the discharge tube 30, opening valve assembly 50, and applying a vacuum, material will flow through the end of the outlet gate assembly 20 to which the vacuum hose 60 is attached and the necessary air flow to properly empty the hopper car 10 will be drawn into the opposite end of the discharge tube 30.

A manually operable rotatable valve assembly 50 is mounted within the discharge opening 26 of the outlet gate assembly 20 between the spaced vertical sidewalls 25. Referring to FIGS. 4-9, rotatable valve assembly 50 is formed with two separate valve components 52 and 152 axially aligned and disposed respectively on opposite sides of central valve shaft support 37. The separate valve components 52 and 152 may be rotated together, or separately, when unloading the hopper car 10 as explained below.

Near end valve component 52 includes a central shaft 53 and far end valve component 152 includes a central shaft 153 upon which are attached generally elongate flat valve plates 54 and 154, respectively. The elongate flat valve plates 54 and 154 are configured and dimensioned so as to seal against sidewalls 25 of the discharge opening 26 when the elongate flat valve plates 54 and 154 are oriented in a generally horizontal position. If desired, resilient sealing members (not shown) may be positioned on or along the sidewalls 25 or the valve plates 54 and 154 to improve the sealing engagement between the sidewalls and the valve plates 54 and 154.

Referring to FIGS. 4-7, valve components 52 and 152 of valve assembly 50 are rotatably supported or mounted within outlet gate assembly 20 by a pair of outer bushings 80 supported in the near end and far end brackets 43 aligned with the openings 29 in end walls 28 and a pair of inner bushings 81 supported in central valve shaft support 37. The outer ends of shafts 53 and 153 extend through the bushings 80 at the near end and far end brackets 43 and are exposed externally of the outlet gate assembly 50 between the brackets 43 and the cylindrical outlet tubes 41.

Operating handles 51 and 151 are provided to operate valve assembly 50 from either transverse side of railroad car hopper 10. Near end handle 51 is connected to an exposed transverse outer end of shaft 53. Far end handle 151 is connected to an exposed transverse outer end of shaft 153. The valve plates 54 and 154 may be separately opened, or closed as desired from either side of the railroad car 10 through manipulation of either handles 53 or 153 as discussed further below.

Figure 14:
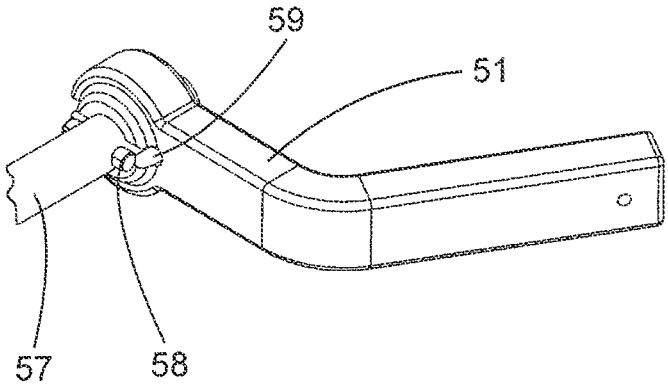
FIG. 14 is a fragmented perspective view of a handle of the outlet gate assembly of FIG. 2 with the handle in an inoperative position.
Figure 15:
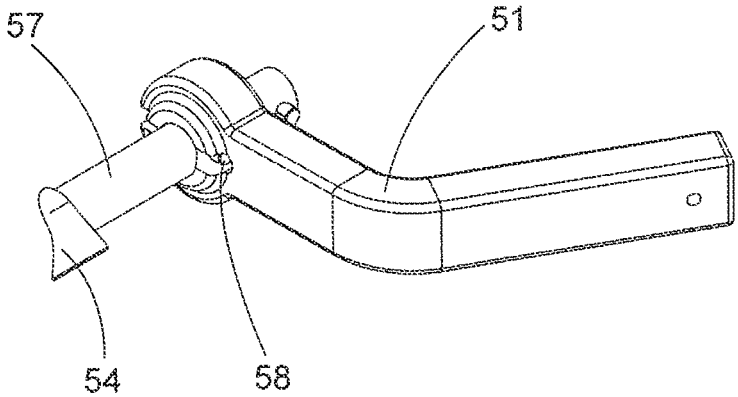
FIG. 15 is a fragmented perspective view of the handle of FIG. 11 with the handle in an operative position.

As here illustrated, handles 51 and the outer ends 57 and 157 of shafts 53 and 153 may be configured so that the handles rotate with the shafts only after engaging the handles 51 or 151 to the shaft 53 or 153 in an operative relation. In an example depicted in FIGS. 14-15, the outer end 57 of shaft 53 includes a pin or post 58 that extends through the shaft. The handle 51 is axially slidable along the shaft 53 and has a collar with a slot or recess 59 configured to receive the pin 58 therein. When handle 51 is in the position depicted in FIG. 14 (i.e., with the pin 58 spaced from the slot 59), the shall 53 may rotate relative to the handle 51. Upon sliding the handle 53 towards the pin 58 and aligning the pin with the slot 59 depicted in FIG. 15, the handle will rotate with shaft 53. The far side handle 151 and the far side shaft 153 may be similarly configured. In another example, the ends of shafts 53 and 153 may be splined (not shown), and each handle 51 and 151 may be axially slidable to engage or disengage a similarly shaped aperture in the handle 51 or 151 with the spline of its associated shaft.

Figure 7:
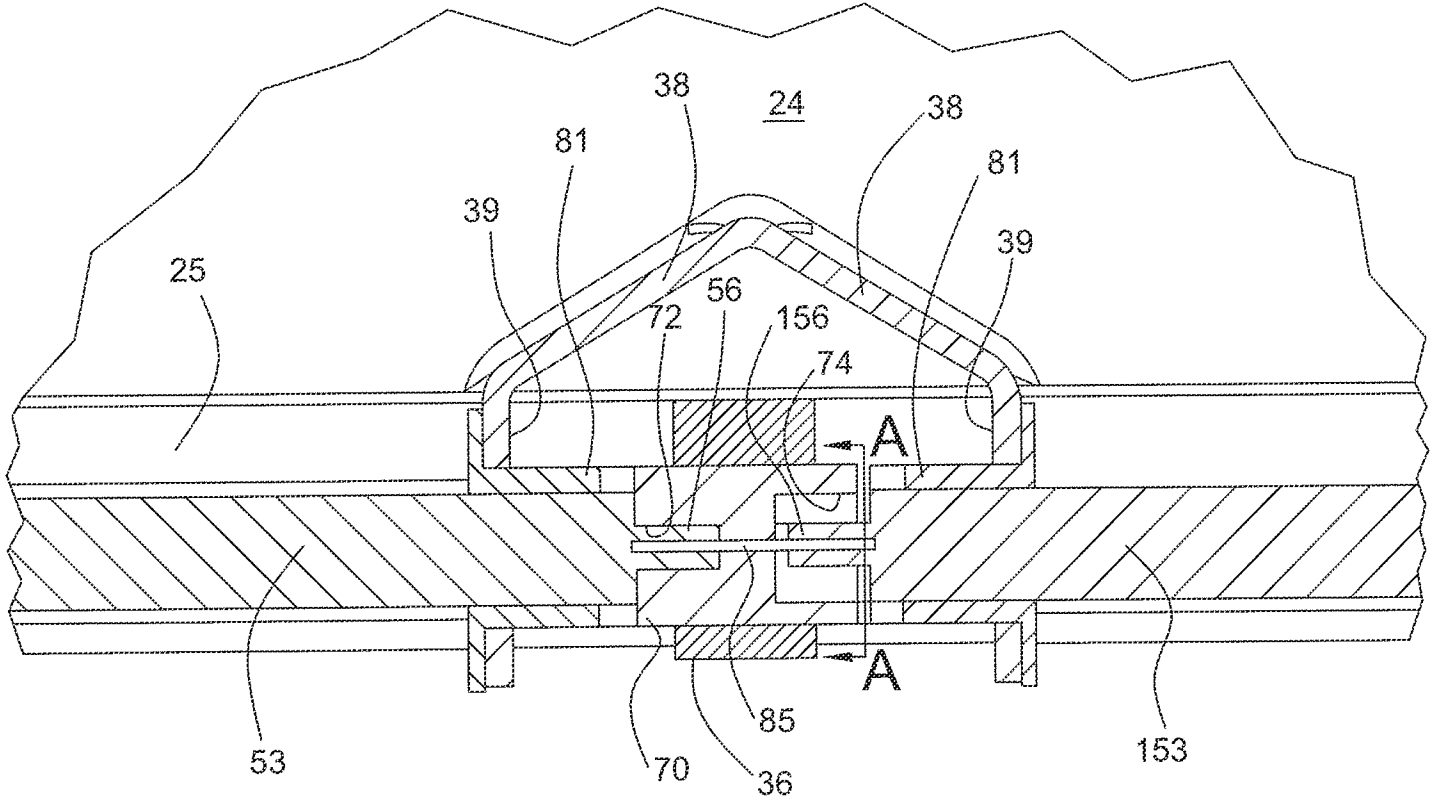
FIG. 7 is an enlarged sectional side view of a portion of FIG. 4.

Inner end of central shaft 53 includes an elongate projection, or rib, 56 that extends into the central valve shaft support 37 from the near side. Similarly, a transversely inner end of central shaft 153 includes a transversely elongate projection 156 that extends into the central valve shaft support 37 from the far side. The projections are elongated radially in a direction perpendicular to the longitudinal axis of the axially aligned shafts 53 and 153. The elongated projection 56 and 156 of each shaft is circumferentially aligned with the respective flat valve plates 54 and 154. As best seen in FIG. 7, the projections 56 and 156 of shafts 53 and 153 are connected for axial alignment by pin 85 rotatably received in holes in the inward facing ends of the shafts 53 and 153 at projections 56 and 156. In an alternate embodiment, pin 85 may be replaced by a pair of co-linear pins (not shown) with each pin extending from one of the projections 56 or 156 and into the bore 78 in the coupling 70. In still another embodiment, the pin 85 or pins may be omitted.

Utilizing either the handle 51 or handle 151, an operator may optionally discharge particulate lading through one or both valve components 52 and 152. In this regard, the generally cylindrical lost motion coupling 70 is positioned between the facing inner ends of the shafts 53 and 153 of the valve assembly 50. Lost motion coupling may be rotatably mounted and supported at the coupler pocket between the walls 39 by a bearing or pillow block 36 that is secured to the body 21 of outlet gate assembly 20. In an alternate embodiment, the coupling 70 may be fixed or secured to the near side shaft 53 so that the coupling is insertable into and removable from the opening 29 in end wall 28 with the near side shaft.

One end face 71 of the coupling 70 includes an elongated groove or recess 72 (FIGS. 6 and 8) dimensioned to receive the elongated rib 56 of the near side shaft 53 in a direct driving relationship. That is, rotation of the shaft 53 will cause a corresponding rotational movement of the coupling 70. Similarly, rotation of coupling 70 will cause a corresponding rotational movement of shaft 53. As a result, the shaft 53, and its valve component 52, and the coupling 70 are directly coupled or linked so that rotation of the shaft 53, or the coupling 70, will result in the rotation of the other.

The opposite end face 73 of coupling 70 includes a lost-motion aperture or recess 74 (FIGS. 8-9) that includes a first pair of oppositely facing, offset engagement walls 76 and a second pair of oppositely facing offset engagement walls 77. The first pair of engagement walls 76 are generally perpendicular to the second pair of engagement walls 77.

The engagement walls 76 and 77 of lost motion recess 74 are offset relative to diametric planes passing through the axis or center of rotation of shafts 53 and 153 sufficiently to accommodate the elongated rib 156 of the far side central shaft 153 of the valve component 152, and also permit limited rotational movement of the valve component 154 relative to the coupling 70. As a result, the shaft 153 and coupling 70 are coupled in a lost motion relationship.

More specifically, as illustrated herein, the lost motion recess 74 permits a maximum of ninety degrees of relative rotation between the far side elongated rib 156 (and shaft 153) and the coupling 70. Rotation of the coupling 70 by rotation of shaft 53 in one direction greater than ninety degrees (90°) results in rotation of the far side rib 156 and thus shaft 153 and its valve component 152.

As a result, the shaft 53 has a direct driving relation to coupling 70, because it has the rib 56 engaged in recess 72 of coupling 70, and that may be rotated to rotate the coupling and intermittently drive the opposite shaft 153 which has rib 156 that engages the lost motion recess 74. In the alternative, the shaft 153 that engages the lost motion recess 74 may be rotated to intermittently rotate the coupling 74 and the opposite shaft 53 as described in further detail below. Other configurations of the lost motion recess 74 are contemplated.

Similarly, if the coupling 70 is then rotated in the opposite direction, it may be rotated ninety degrees (90°) without moving projection 156. Continued rotation of the coupling 70 in the same direction will then cause the projection 156 and consequently shaft 153 to rotate with the coupling 72.

Figure 8:
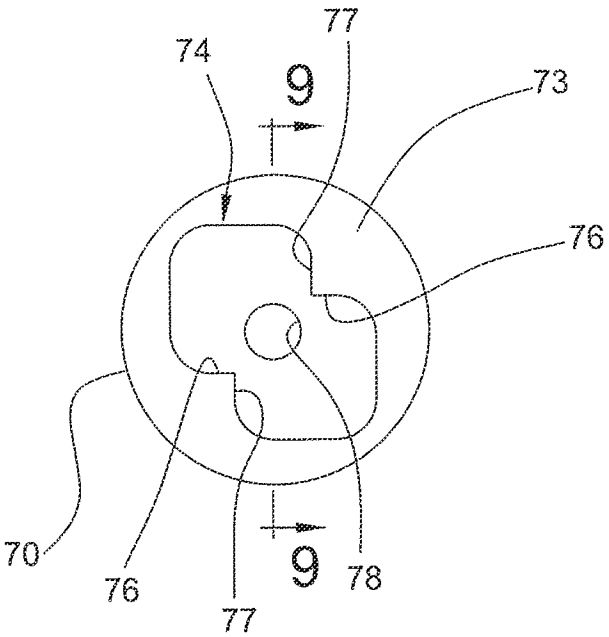
FIG. 8 is an end view of a lost motion coupling of the present disclosure.
Figure 9:
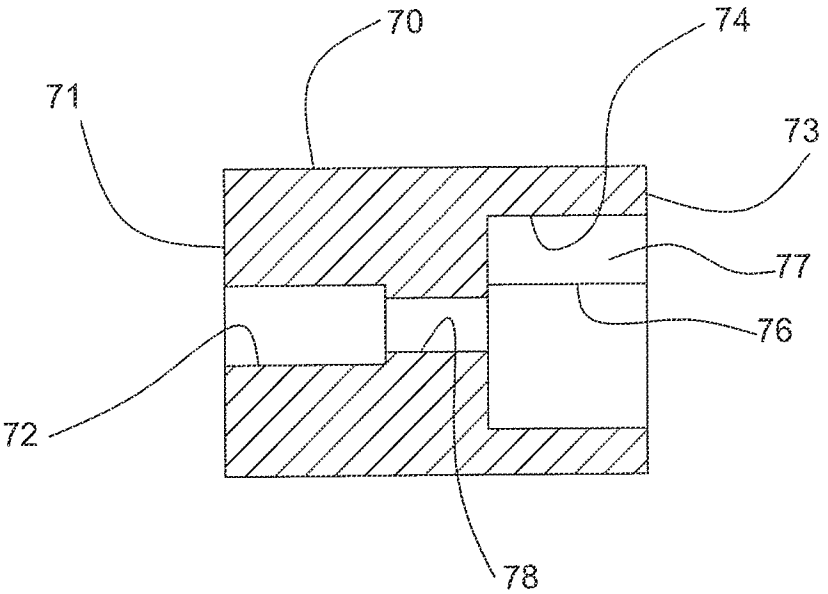
FIG. 9 is a side sectional view of the lost motion coupling of FIG. 8 taken along the line 9-9 of FIG. 8.

Also, as seen in FIGS. 8 and 9, the coupling 70 includes a central bore 78 to accommodate the shaft 85 that serves to maintain axial alignment of shaft 53 and 153.

Referring to FIGS. 10 to 13, the discharge valve assembly 50 is operable from either side of railroad hopper car 10 through manipulation of the shaft 53 and 153 using handles 51 or 151 which are rotatable through an arc of approximately one hundred eighty degrees (180°). The handles 51 and 151 are normally arranged such that they rest to a left generally horizontal position as viewed by a user. Thus, to a user, standing beside the car 10 the handle 51 and 151 can be rotated clockwise about 180° and then returned to its original position by rotating it counter-clockwise about 180°.

The operation of discharge valve assembly 50 is described below in reference to FIGS. 10 to 13. These figures depict the far side end of face 73 of lost motion coupling 70 viewed from the far side of the hopper car 10 with a section through the projection 156 of the far side shaft 153. The sectional line depicted by these figures is shown by the line A-A in FIG. 7.

The positions of the elongate flat valve plates 54 and 154 are also discernible in FIGS. 10 to 13. The valve plate 54 of valve component 52 is visible. The far side valve plate 154 of far side valve component 152 is aligned with projection 156 and its position is indicated by the position of projection 156. That is, if the projection 156 is horizontal, the valve plate 154 is also horizontal and is closed. If the projection 156 is vertical, valve plate 154 is also vertical and is fully open.

Figure 10:
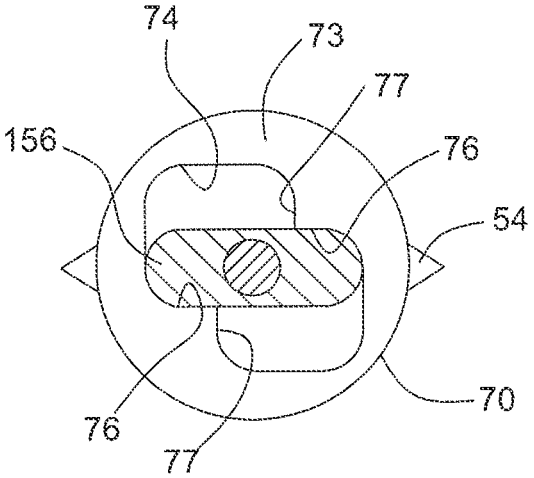
FIGS. 10-13 are sectional views of the outlet gate assembly of FIG. 2 taken along the line A-A of FIG. 7 depicting a sequence of operation of the outlet gate assembly.
Figure 11:
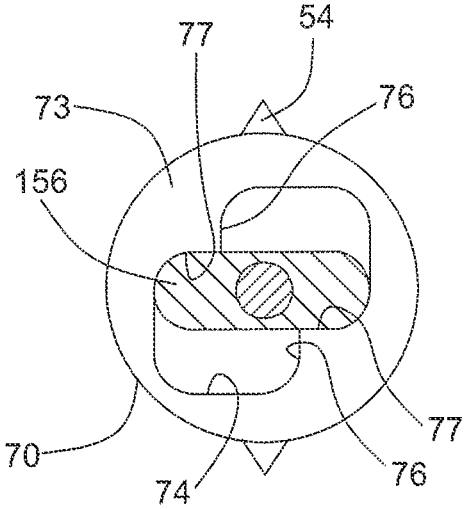

Referring to FIG. 10, the valve assembly 50 is illustrated with both valve components 52 and 152 closed and sealed against discharge from a hopper 18 into discharge tube 30. To operate the valve assembly 50, a user on the near side of a car first rotates shaft 53 ninety degrees (90°) in a clockwise direction as viewed by the user. This moves valve plate 54 to a fully open position as seen in FIG. 11. Since the shaft 153 and coupling 70 are connected and thus configured to rotate together, the rotation of shaft 53 causes coupling 70 to rotate ninety degrees (90°) in a counter-clockwise direction as viewed in FIGS. 10 to 13.

Counter-clockwise rotation of coupling 70 causes the first pair of engagement walls 76 to rotate away from the rib 156 from a horizontal orientation depicted in FIG. 10 to a vertical orientation as depicted in FIG. 11. The rib 156 and its shaft 153 do not rotate and, as illustrated by the horizontal position of projection 156, valve plate 154 remains closed.

Figure 12:
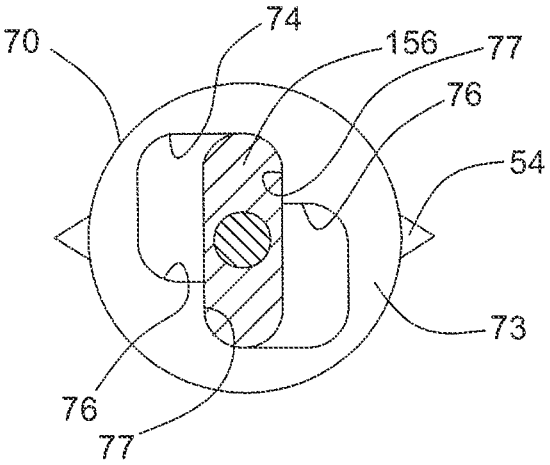

Continued counter-clockwise rotation of near side shaft 53 from the position depicted in FIG. 11 to that depicted in FIG. 12 causes counter-clockwise rotation of coupling 70 due to their direct connection. The counter-clockwise rotation of coupling 70 and the engagement of the second pair of engagement walls 77 with the projection 156 causes the shaft 153 to rotate in a counter-clockwise manner with the coupling 70 to a vertical position, which reflects a fully open position of valve plate 154. Such movement, implemented by continued clockwise rotation of shaft 53 by a user on the near side of car 10, causes flat valve plate 54 to move to a horizontal or closed position as illustrated in FIG. 12. At this position, valve plate 54 is fully closed and valve plate 154 is fully open.

Figure 13:
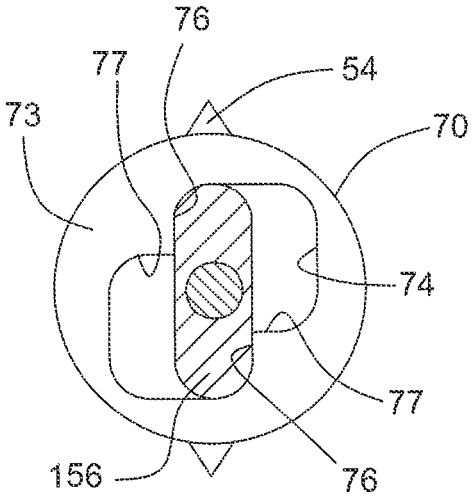

Rotation of the handle 51 on the near side of hopper car 10 in a counter-clockwise direction ninety degrees (90°) will return the valve plate 54 to a vertical or open position as depicted in FIG. 13. Such movement results in clockwise rotation of coupling 70 (as viewed from the far side of car 10 and depicted in FIGS. 10 to 13). This clockwise rotation causes engagement walls 77 to move away from engagement with projection 156 of shaft 153 and engagement walls 76 to move into engagement with projection 156 but results in no rotational movement of shaft 153. Consequently, both valve components 52 and 152 are fully open as seen in FIG. 13.

A further ninety degrees (90°) of counter-clockwise rotation of shaft 53 by a user at the near side of car 10 causes valve plate 54 to return to a horizontal or closed position, closing valve component 52. The direct connection between projection 56 and coupling 70 causes counter-clockwise rotation of the coupling. The counter-clockwise rotation of the engagement walls 76 of lost motion aperture 24 causes clockwise rotation of projection 156 of shaft 153 (as viewed from far side of car 10) closing valve plate 154 of valve component 152. This position is the original position depicted in FIG. 10.

Operation of the valve assembly 50 from the far side of car 10 proceeds in a similar fashion but is depicted by a different sequence of positions as compared to those depicted in FIGS. 10-13. The discharge valve assembly is fully closed at the position depicted in FIG. 10. The operator rotates handle 151 ninety degrees (90°) in a clockwise direction (as viewed by the operator). Clockwise rotation of handle 151 and shaft 153 results in clockwise rotation of valve plate 154 which moves it to a vertical position as illustrated by projection 156 in FIG. 12 and fully opens the valve plate 154 of valve component 152. No movement of shaft 53 occurs. Rather, projection 156 moves clockwise within lost motion recess 74 away from engagement walls 76 and into contact with engagement walls 77 from the position depicted if FIG. 10 to the position depicted in FIG. 12.

Continued clockwise rotation of handle 151 and shaft 153 causes projection 156 to rotate coupling 70 clockwise, and moves flat valve plate 54 into a vertical or fully open position as depicted in FIG. 11. Projection 156 is positioned horizontally and consequently flat valve plate 154 of valve component 152 is closed.

Counter-clockwise rotation of handle 151 and shaft 153 causes flat valve plate 154 to rotate counter-clockwise into a vertical or open position as illustrated in FIG. 13 at which both valve components 52 and 152 are fully open. During the counter-clockwise rotation of shaft 153, coupling 70 does not rotate since projection 156 moves from contact with engagement walls 77 to contact with engagement walls 76 as may be seen by comparing FIG. 11 to FIG. 13.

Continued rotation of handle 151 and shaft 153 ninety degrees (90°) in a counter-clockwise direction, as viewed from the far side of ear 10, returns flat valve plate 154 of valve component 152 to a horizontal or closed position as seen in FIG. 10. Coupling 70 is also rotated ninety degrees (90°) through the engagement of projection 156 with engagement walls 76 to rotate shaft 53 ninety degrees (90°) and positioning flat valve plate 54 in a horizontal or closed position.

As described, the valve assembly 50 is fully functional or operational from either side of the hopper car 10 through one hundred eighty degrees (180°) of clockwise and counter-clockwise rotation of shaft 53 or 153 using handles 51 or 151.

By providing discharge valve assembly 50 including valve components 52 and 152 together with the coupling 70, the valve assembly 50 may be partially opened or fully opened from either side of the hopper ear 10. In addition, the configuration of the valve assembly 50 simplifies disassembly of the valve assembly 50 from the body 21 of the outlet gate to permit cleaning of the outlet gate assembly without the need to remove the outlet gate assembly 20 from the hopper car 10. More specifically, the end adapter 40 may be removed from each end wall 28 and the valve components 52 and 152 each removed from the body 21 of the outlet gate assembly 20 by sliding the valve components through the openings 29 in the end walls 28.

It will be appreciated that the foregoing description provides examples of the disclosed system and technique. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The invention claimed is:

1. An outlet gate assembly for a hopper car comprising:

a body having a first end and a second end and an elongated discharge opening extending between the first end and the second end;

an elongated discharge conduit generally adjacent the discharge opening and extending along a length thereof, the discharge conduit having a first discharge end and a second discharge end and being configured to pass material through either of the first discharge end and the second discharge end; and a valve assembly to control flow of material from the discharge opening into the discharge conduit, the valve assembly including a rotatable direct motion valve component and a rotatable lost motion valve component and a lost motion coupling coupled to the direct motion valve component for rotation therewith, the lost motion valve component rotatably coupled to said lost motion coupling for rotation therewith, but with limited relative rotational movement therebetween, each of the direct motion valve component and the lost motion valve component being rotatable to move between an open position and a closed position relative to one of said first discharge end and said second discharge end, the valve assembly being operable from either the first end or the second end of the body.

2. The outlet gate assembly of claim 1, wherein the direct motion valve component and the lost motion valve component are each rotatably mounted adjacent the discharge opening, and each of the direct motion valve component and the lost motion valve component is configured to rotate separately or together with the other valve component between its respective open and closed positions.

3. The outlet gate assembly of claim 1, wherein the direct motion valve component and the lost motion coupling are operatively connected to rotate together and the lost motion valve component and the lost motion coupling are operatively connected to rotate together after a lost motion rotation of the lost motion coupling relative to the lost motion valve component.

4. The outlet gate assembly of claim 1, wherein the valve assembly is positioned between the discharge opening and the discharge conduit.

5. The outlet gate assembly of claim 1, wherein the body includes sloped walls for directing material towards the discharge opening.

6. The outlet gate assembly of claim 1, wherein the direct motion valve component and the lost motion valve component each includes a central shaft and a generally flat valve plate that interacts with a discharge opening to prevent flow of material through the discharge opening.

7. The outlet gate assembly of claim 6, further including a central valve shaft support and the lost motion coupling is positioned generally adjacent the central valve shaft support.

8. An outlet gate assembly for a hopper car comprising:

a body having a first end and a second end and an elongated discharge opening extending between the first end and the second end;

an elongated discharge conduit generally adjacent the discharge opening and extending along a length thereof, the discharge conduit having a first discharge end and a second discharge end and being configured to pass material through either of the first discharge end and the second discharge end; and a valve assembly to control flow of material from the discharge opening into the discharge conduit, the valve assembly including a direct motion valve component and a lost motion valve component and a lost motion coupling between the direct motion valve component and the lost motion valve component, each of the direct motion valve component and the lost motion valve component being rotatable to move between an open position and a closed position, the valve assembly being operable from either the first end or the second end of the body wherein the direct motion valve component and the lost motion valve component each includes a central shaft having an inner end;

the lost motion coupling includes a direct motion face and a lost motion face facing in a direction opposite the direct motion face;

one of the inner end of the direct motion valve component and the direct motion face has a direct motion projection and another of the inner end of the direct motion valve component and the direct motion face has a complimentary direct motion recess in which the direct motion projection is positioned to prevent relative rotation between the direct motion valve component and the lost motion coupling; and one of the inner end of the lost motion valve component and the lost motion face has a lost motion projection and another of the inner end of the lost motion valve component and the lost motion face has a lost motion recess in which the lost motion projection is positioned, the lost motion recess permitting relative rotation between the lost motion valve component and the lost motion coupling.

9. The outlet gate assembly of claim 8, wherein the lost motion recess is configured to permit 90 degrees of relative rotation between the lost motion valve component and the lost motion coupling upon rotating the lost motion valve component relative to the lost motion coupling in a direction opposite a direction in which the lost motion valve component and the lost motion coupling were rotated together.

10. The outlet gate assembly of claim 8, wherein the inner end of the direct motion valve component has a generally elongated radially extending direct motion rib and the direct motion face of the last motion coupling has a generally elongated radially extending recess dimensioned to receive the direct motion rib therein and prevent relative rotation between the direct motion valve component and the lost motion coupling; and the inner end of the lost motion valve component has a generally elongated radially extending lost motion rib and the lost motion face of the lost motion coupling has a lost motion recess dimensioned to receive the lost motion rib therein, the lost motion recess has a first pair of oppositely facing, offset engagement walls and a second pair of oppositely facing offset engagement walls, the first pair of engagement walls being generally perpendicular to the second pair of engagement walls.

11. The outlet gate assembly of claim 10, wherein the lost motion recess is configured to permit a maximum of 90 degrees of relative rotation between the lost motion valve component and the lost motion coupling.

12. The outlet gate assembly of claim 11, wherein the 90 degrees of relative rotation occurs upon rotating the lost motion valve component relative to the lost motion coupling in a direction opposite a direction in which the lost motion valve component and the lost motion coupling were rotated without relative rotation between the lost motion valve component and the lost motion coupling.

13. The outlet gate assembly of claim 6, wherein the direct motion valve component and the lost motion valve component are each supported by an inner bushing and an outer bushing.

14. An outlet gate assembly for a hopper car comprising:

an elongated body having a first end and a second end and an elongated discharge opening extending therebetween;

an elongated discharge conduit to receive material from said discharge opening and including a first discharge end and a second discharge end, each configured to pass material therefrom;

a valve assembly rotatably operable relative to said discharge opening to control flow of material from said discharge opening into said discharge conduit including a rotatable direct motion valve component and a rotatable lost motion valve component, each including a valve plate associated with said discharge opening rotatable between a closed position and an open position, and a lost motion coupling directly connected to said direct motion valve component for rotation therewith and having a lost motion connection to said lost motion valve component permitting limited relative rotational movement therebetween.

15. The outlet gate assembly of claim 14, further including a central valve shaft support and the lost motion coupling is positioned generally within said central valve shaft support.

16. The outlet gate assembly of claim 14, wherein the direct motion valve component and the lost motion valve component each include a central shaft having an inner end;

the lost motion coupling includes a direct motion face and a lost motion face facing in a direction opposite the direct motion face;

one of the inner end of the direct motion valve component and the direct motion face has a direct motion projection and another of the inner end of the direct motion valve component and the direct motion face has a complimentary direct motion recess in which the direct motion projection is positioned to provide said direct connection therebetween.

17. The outlet gate assembly of claim 16 wherein one of the inner end of the lost motion valve component and the lost motion face has a lost motion projection and another of the inner end of the lost motion valve component and the lost motion face has a lost motion recess in which the lost motion projection is positioned, the lost motion recess permitting a maximum of 90 degrees of relative rotation between the lost motion valve component and the lost motion coupling.

18. A method of discharging material from an outlet gate assembly of a hopper car, the outlet gate assembly having a body with a first end and a second end and an elongated discharge opening between the first end and the second end, an elongated discharge conduit generally adjacent the discharge opening and extending along a length thereof the discharge conduit having a first discharge end and a second discharge end and being configured to pass material through either of the first discharge end and the second discharge end, and a valve assembly to control flow of material from the discharge opening into the discharge conduit, the valve assembly including a rotatable direct motion valve component and a rotatable lost motion valve component and a lost motion coupling coupled to the direct motion valve component for rotation therewith, the lost motion valve component rotatably coupled to said lost motion coupling for rotation therewith, but with limited relative rotational movement therebetween, each of the direct motion valve component and the lost motion valve component being rotatable to move between an open position and a closed position, the valve assembly being operable from either the first end or the second end of the body, the method comprising:

a) rotating the direct motion valve component ninety degrees in a first direction relative to the discharge opening from a closed position to an open position to permit material to flow through the discharge opening along the direct motion valve component while the lost motion valve component remains positioned at a closed position;

b) rotating the direct motion valve component and the lost motion valve component together ninety degrees in the first direction to rotate the direct motion valve component from the open position to the closed position to prevent material from flowing through the discharge opening and to rotate the lost motion valve component relative to the discharge opening from a closed position to an open position to permit material to flow through the discharge opening along the lost motion valve component;

c) rotating the direct motion valve component ninety degrees in a second direction opposite the first direction from the dosed position to the open position to permit material to flow through the discharge opening along the direct motion valve component while the lost motion valve component remains at the open position to permit material to flow through the discharge opening along the lost motion valve component; and d) rotating the direct motion valve component and the lost motion valve component together ninety degrees in the second direction to rotate the direct motion valve component from the open position to the closed position to prevent material from flowing through the discharge opening and to rotate the lost motion valve component from the open position to the closed position to prevent material from flowing through the discharge opening.

19. The method of claim 18, further including rotating the lost motion coupling with the direct motion component in steps a) through d) above and rotating the lost motion coupling relative to the lost motion coupling in steps a and c above.

20. A lost motion coupling for rotatably connecting a rotatable direct motion component to a rotatable lost motion component, the direct motion component having a direct motion rib at an inner end thereof, and the lost motion component having a lost motion rib at an inner end thereof the lost motion coupling comprising:

a body having a direct motion face and an oppositely facing lost motion face;

the direct motion face having a direct motion slot configured to engage the direct motion rib and prevent relative rotatable motion between the direct motion rib and the direct motion slot; and the lost motion face having a lost motion recess including a first pair of oppositely facing, offset engagement walls and a second pair of oppositely facing offset engagement walls, the first pair of engagement walls being generally perpendicular to the second pair of engagement walls, the lost motion recess being configured to engage the lost motion rib and permit a maxi mum of ninety degrees of relative rotatable motion between the lost motion rib and lost motion recess.

* * * * *